US006227298B1

(12) United States Patent
Patel

(10) Patent No.: US 6,227,298 B1
(45) Date of Patent: May 8, 2001

(54) WELL ISOLATION SYSTEM

(75) Inventor: Dinesh R. Patel, Sugar Land, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 0 days.

(21) Appl. No.: 09/177,400

(22) Filed: Oct. 23, 1998

Related U.S. Application Data

(60) Provisional application No. 60/069,629, filed on Dec. 15, 1997.

(51) Int. Cl.[7] ..... E21B 34/10

(52) U.S. Cl. ..... 166/321; 166/313; 166/386

(58) Field of Search ..... 166/321, 386, 166/313, 332.4, 373, 374

(56) References Cited

U.S. PATENT DOCUMENTS

| | | | | |
|---|---|---|---|---|
| 2,798,561 | * | 7/1957 | True | 166/324 |
| 2,951,536 | | 9/1960 | Garrett . | |
| 2,963,089 | | 12/1960 | Sizer . | |
| 3,412,806 | | 11/1968 | Fredd . | |
| 3,640,341 | | 2/1972 | Braddick et al. . | |
| 3,912,008 | | 10/1975 | Crowe . | |
| 4,043,392 | * | 8/1977 | Gazda | 166/217 |
| 4,143,712 | * | 3/1979 | James et al. | 166/72 |
| 4,215,746 | | 8/1980 | Hallden et al. . | |
| 4,280,561 | | 7/1981 | Fredd . | |
| 4,354,554 | * | 10/1982 | Calhoun et al. | 166/321 |
| 4,356,867 | | 11/1982 | Carmody . | |
| 4,417,600 | | 11/1983 | Kohn . | |
| 4,420,045 | | 12/1983 | McMahan . | |
| 4,589,482 | * | 5/1986 | Bayh, III | 166/105.5 |
| 4,624,310 | * | 11/1986 | Echols et al. | 166/106 |
| 4,627,492 | | 12/1986 | MacLaughlin . | |
| 4,979,569 | | 12/1990 | Anyan et al. . | |
| 5,058,673 | | 10/1991 | Muller et al. . | |
| 5,090,481 | | 2/1992 | Pleasants et al. . | |
| 5,257,663 | * | 11/1993 | Pringle et al. | 166/66.4 |
| 5,263,683 | | 11/1993 | Wong . | |
| 5,337,827 | | 8/1994 | Hromas et al. . | |
| 5,518,073 | | 5/1996 | Manke et al. . | |
| 5,664,629 | | 9/1997 | Maitland . | |
| 5,810,087 | | 9/1998 | Patel . | |
| 5,941,308 | * | 8/1999 | Malone et al. | 166/313 |

FOREIGN PATENT DOCUMENTS

| | | |
|---|---|---|
| 0 859 123 A2 | 8/1998 | (EP) . |
| 2 213 181 | 8/1989 | (GB) . |
| WO 92/08875 | 5/1992 | (WO) . |

OTHER PUBLICATIONS

Schlumberger, *Formation Isolation Valve* (*FIV*), p. 1, (Jan. 1997).

Schlumberger, *Liner Top Isolation Valve—LTIV*, p. 1 (Publication Date Unknown).

Schlumberger, *Formation Isolation Valve* (*FIV*), p. 1 (Aug. 1997).

Schlumberger, *Liner Top Isolation Valve—(LTIV*)*, p. 1 (Sep. 1997).

Schlumberger, *IRIS* Operated Dual Valve* (*IRDV–AB*), p. 1 (Oct. 1997).

Schlumberger, *Single–Shot Reversing Valve* (*SHRV*), p. 1 (Dec. 1996).

* cited by examiner

*Primary Examiner*—Hoang Dang
(74) *Attorney, Agent, or Firm*—Trop, Pruner & Hu P.C.

(57) ABSTRACT

A formation isolation valve assembly for use in a well includes first and second fluid paths that are coupled to at least first and second completion zones. A first valve controls fluid flow from the first zone to the first fluid path, and a second valve controls fluid flow from a second zone to the second fluid path. The valves may include ball valves and sleeve valves.

6 Claims, 11 Drawing Sheets

WELL ISOLATION SYSTEM

This application claims priority under 35 U.S.C. § 119 to U.S. Provisional Patent Application Serial No. 60/069,629, filed on Dec. 15, 1997.

BACKGROUND

The invention relates to well isolation systems.

In a wellbore, one or more valves may be used to control flow of fluid between different sections of the wellbore. Such valves are sometimes referred to as formation isolation valves. A formation isolation valve may include a ball valve, a flapper valve, or a sleeve valve that is controllable to open or shut sections of the well.

In wells with multiple completion zones, valves are also used to isolate the different zones. Typically during completion of multiple zone wells, a first zone is perforated using a perforating string to achieve communication between the wellbore and adjacent formation and the zone may be subsequently completed. If completion of a second zone is desired, a valve may be used to isolate the first zone while the second zone completion operation proceeds. Additional valves may be positioned in the wellbore to selectively isolate one or more of the multiple zones.

In a selective zone completion where flow from each zone is flowed and controlled individually, the individual zones are separated by flow tubes. These flow tubes may have to be passed through the valves in an upstream zone to access a downstream zone. To do so, the valves are opened; for example, if flapper valves are used, they are broken by applied pressure or some mechanical mechanism so that the equipment may pass through the upstream zone to the downstream zone. Once the flapper valve is broken, however, the upstream zone is unprotected and the well may start taking fluid until the equipment has been run to and set in the downstream zone. Because zones may be large distances apart (e.g., thousands of feet), the time for the equipment to traverse the distance between the zones may be long, especially if relatively sophisticated equipment such as those in intelligent completion systems are used.

During this time, fluid pressure from the first zone is monitored to detect sudden fluctuations in well pressure which may cause a blowout condition. If well control is required, such as by activation of a blowout preventer (BOP), closing the BOP on tubing which may have cables, flat packs, and hydraulic lines attached to the outer surface of the tubing may damage the attached components and the BOP may not seal properly.

Thus, an improved isolation system is needed that reliably provides fluid control in a well.

SUMMARY

In general, according to an embodiment, the invention features a valve assembly for use in a well. The valve assembly includes first and second fluid paths. A first valve controls fluid flow from a first portion of the well to the first fluid path. A second valve controls fluid flow from a second portion of the well to the second fluid path.

Other features will become apparent from the following description and from the claims.

DETAILED DESCRIPTION

According to embodiments of the invention, an improved formation isolation system provides effective fluid loss and well control when running in multiple completion zones to protect the zones until they are ready for production. The formation isolation system according to some embodiments include a combination of a ball valve and a sleeve valve for use in a dual-zone well. The formation isolation system according to further embodiments may include multiple valves for use with more than two zones. In the dual-valve embodiment, the ball valve may isolate a downstream zone while the sleeve valve may isolate an upstream zone. In one embodiment, both valves may be mechanically coupled so that they are actuated open or shut together. In other embodiments, the valves may be separately and independently actuated. Once the formation isolation system is closed and the formation isolated, the upstream completion zone may be run in the well with increased safety. In addition, work strings or perforating gun strings may be removed with increased safety.

In one embodiment, the formation isolation system includes several sections, including: a ball valve section that is rotatable to an open or shut position to isolate a downstream completion zone; a counter trip saver section that allows interventionless opening of the ball valve and that may include an index mechanism to count a predetermined number of pressure cycles before ball valve is actuated; and a sleeve valve section that may be a simple sliding sleeve with packing seals to isolate an upstream completion zone.

Figure 1:
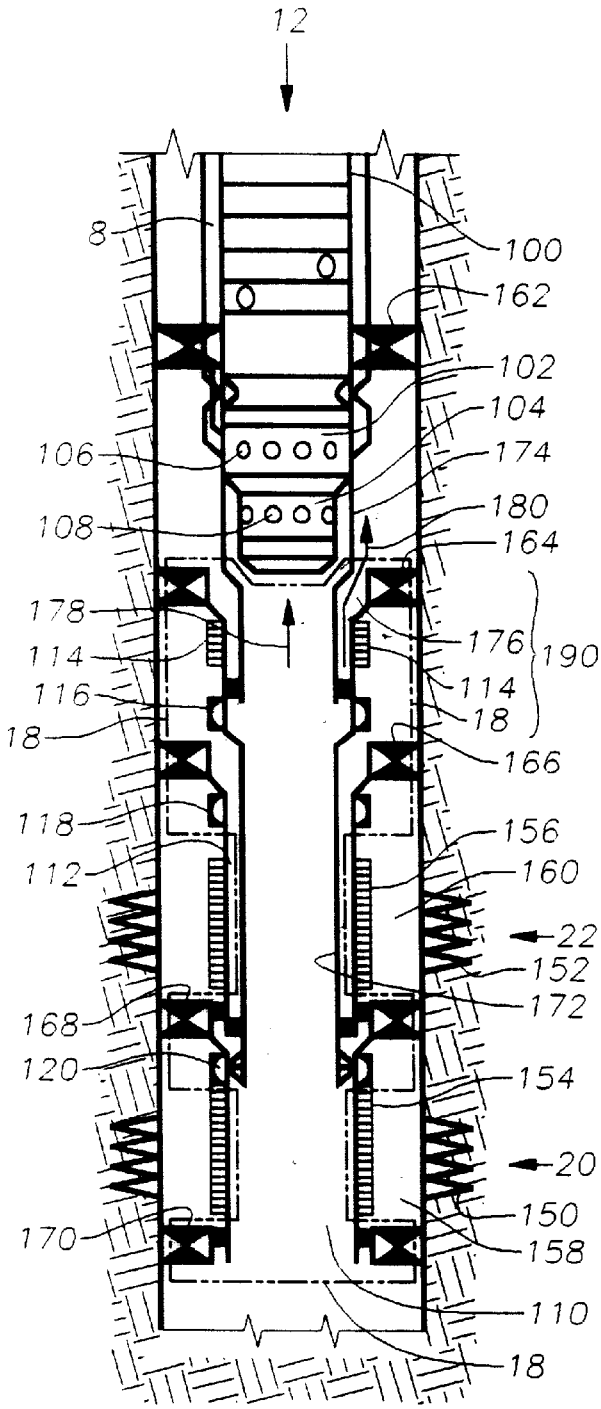
FIG. 1 is a diagram of a well having multiple zones and a formation isolation system according to an embodiment of the invention used to control fluid flow in the well.

Referring to FIG. 1, a tubing string 8 in a wellbore 12 coupled to surface equipment (not shown) is coupled to a formation isolation system 18 according to an embodiment of the invention. In the illustrated embodiment, the formation isolation system 18 includes the various packers, valves, flow tubes, and valve actuation devices, as indicated in dashed lines and further described below. The formation isolation system 18 is used to control fluid flow from completion zones 20 and 22.

As illustrated, the zones 20 and 22 have been completed, with perforations 150 and 152, respectively, formed to allow fluid communication with the wellbore 12. The perforations 150 and 152 are also gravel packed. Screens 154 and 156 are used to hold the gravel packing in place. Once the formation isolation system 18 is set to control fluid flow from the zones 20 and 22, production equipment, e.g., a flow control system that may include various gauges, sensors, and other devices, may be lowered into the well and coupled to the formation isolation system 18. The formation isolation system 18 provides isolation of the two zones 20 and 22 so that equipment may be inserted and removed relatively safely.

The valves may also be opened and closed multiple times with a shifting tool.

According to an embodiment of the invention, the formation isolation system 18 includes multiple passage ways or fluid paths 178 and 180, one each for a corresponding zone. Fluid communication between the different fluid paths is normally not allowed during operation, thereby ensuring isolation of the zones 20 and 22. In the illustrated embodiment, flow control of the different fluid paths 178 and 180 is accomplished by use of a multivalve isolation assembly 190 that includes two different types of valves: a ball valve 116 and a sleeve valve 114. The ball valve 116 is used to control fluid flow from the first zone 20 to the first fluid path 178 and the sleeve valve 114 is used to control fluid flow from the second zone 22 to the second fluid path 180.

The flow control system 100, which may include an intelligent flow control valve, is coupled near the top of the formation isolation system 18. Near its bottom the flow control device 100 includes two valve sections 102 and 104. The bottom valve section 104 includes ports 108 that allow fluid to flow from a first wellbore section 110 that is in communication with the first zone 20. The second valve section 102 includes ports 106 that allow fluid to flow from a second wellbore section 112 that is in fluid communication with the second zone 22.

As illustrated, fluid from the first zone 20 flows through perforations 150 into the first wellbore section 110 up to a ball valve 116. Fluid from the second zone 22 flows through perforations 152 through the second wellbore section 112 to a sleeve valve 114. The valves 114 and 116 are actuable between open and close positions to allow fluid from the zones 20 and 22 to flow through the fluid paths 178 and 180 to the flow control device 100, which can activate one of the valve sections 102 and 104 to select which of zones 20 and 22 to flow to the surface. The valve sections 102 and 104 in the flow control device 100 can independently be closed and opened to control fluid flow from the zones 20 and 22.

Thus, an advantage offered by the formation isolation system 18 according to an embodiment of the invention is that better control of fluid flow may be accomplished. In addition, by using multiple, isolated fluid paths to produce from the different zones, more reliable isolation of multiple perforated zones may be accomplished to reduce the likelihood of inadvertent contamination between zones.

To further isolate other portions of the well, other packers are used, including a packer 162 that is placed around the lower portion of the production tubing 8 to isolate the portions of the well above the packer 162. In addition, packers 164, 166, and 168 are used to isolate different portions of the first and second well sections 110 and 112.

For further flow control, a valve 118 (which may be, for example, a ball valve or flapper valve) is placed right above the second zone 22, and a valve 120 (which may be, for example, a ball valve or flapper valve) is placed right above the first zone 20. In addition, a flow tube (or "stinger") 172 extends from below the multivalve isolation assembly 190 to near the ball valve 120 above the first zone 120. The flow tube 172 provides a sealed path from the first zone 20 to the flow control device 100. A second flow tube 174 extends from above the ball valve 116 in the multivalve isolation assembly 190 to the flow control device 100. The annular space 176 between the flow tube 174 and the inner wall of the wellbore 12 forms part of the second fluid path 180 through which fluid from the second zone 22 flows when the sleeve valve 114 is open.

According to one embodiment of the invention, one mechanism is used to actuate both the sleeve valve 114 and ball valve 116 in the multivalve assembly 190. In this embodiment, described in connection with FIGS. 2–8, the sleeve valve 114 and the ball valve 116 are mechanically coupled such that the activating mechanism is used to open and close the valves 114 and 116 together. An advantage offered by this embodiment is ease of manufacture and reduced cost of the system.

In another embodiment, separate mechanisms may be used to actuate the sleeve valve 114 and ball valve 116. This other embodiment provides the advantage of flexibility in independently opening and closing the valves 114 and 116. Although the illustrated embodiments refer to two zones and two valves in the multivalve assembly 190, other embodiments may include a greater number of valves for use with a corresponding number of zones. In addition, it is contemplated that in some other embodiments that multiple valves may be used to control a well with a single zone.

The valves 114 and 116 are actuatable using a shifting tool or a tripsaver section that is activable by fluid pressure applied down the annulus space between the production tubing 8 and inner wall of the wellbore 12.

Referring to FIGS. 2A–2G, the multivalve isolation assembly 190 of the formation isolation system 18 in a closed position is shown in greater detail. The multivalve isolation assembly 190 is contained by multiple housing sections (204, 226, 252, 258, 296, 388, and 398) that are threadably or otherwise connected together. Near the bottom of the multivalve isolation assembly 190 (FIG. 2G) is located the ball valve 116 in a closed position contained within the lower housing section 204 and held in place by a ball support 202. The ball valve 116 can be actuated between an open and close position by an actuating member 206 that is part of a ball valve operator.

Figure 4A:
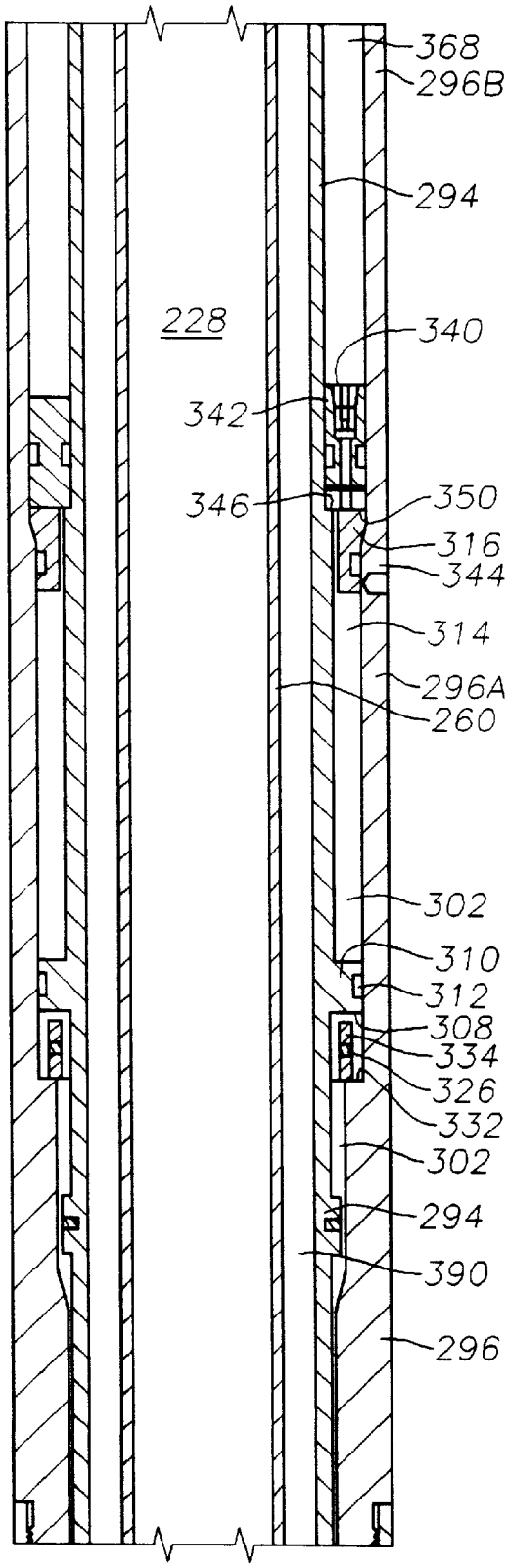
FIGS. 4A–4E are diagrams of the multivalve isolation assembly in an open position after actuation by applied fluid pressure.
Figure 4B:
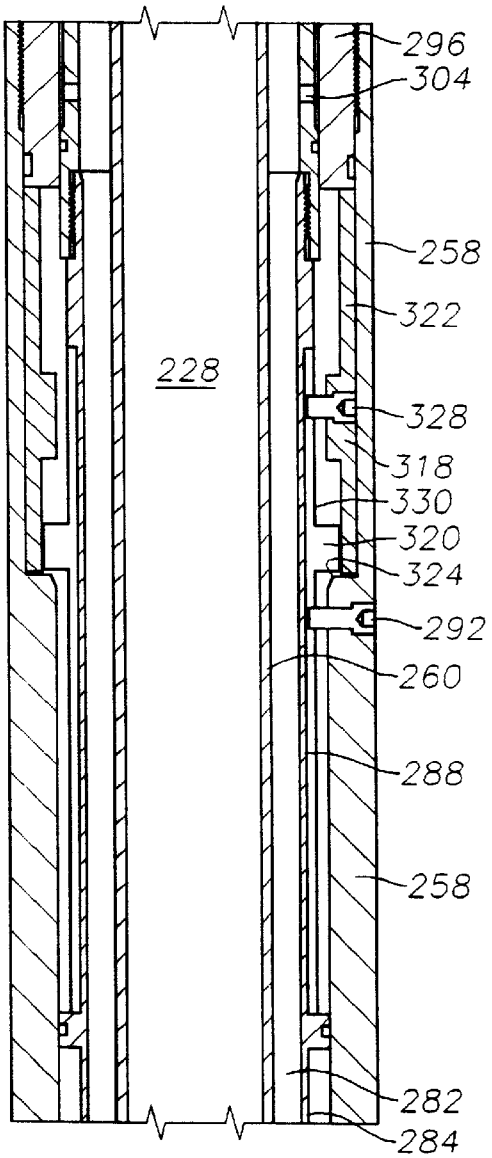
Figure 4C:
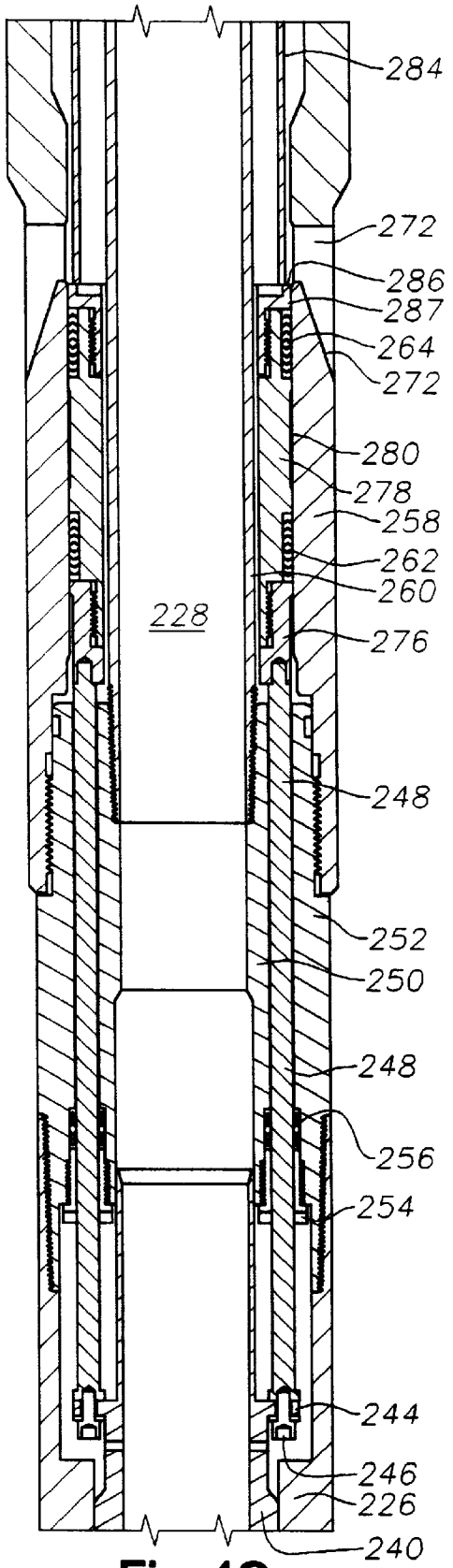
Figure 4D:
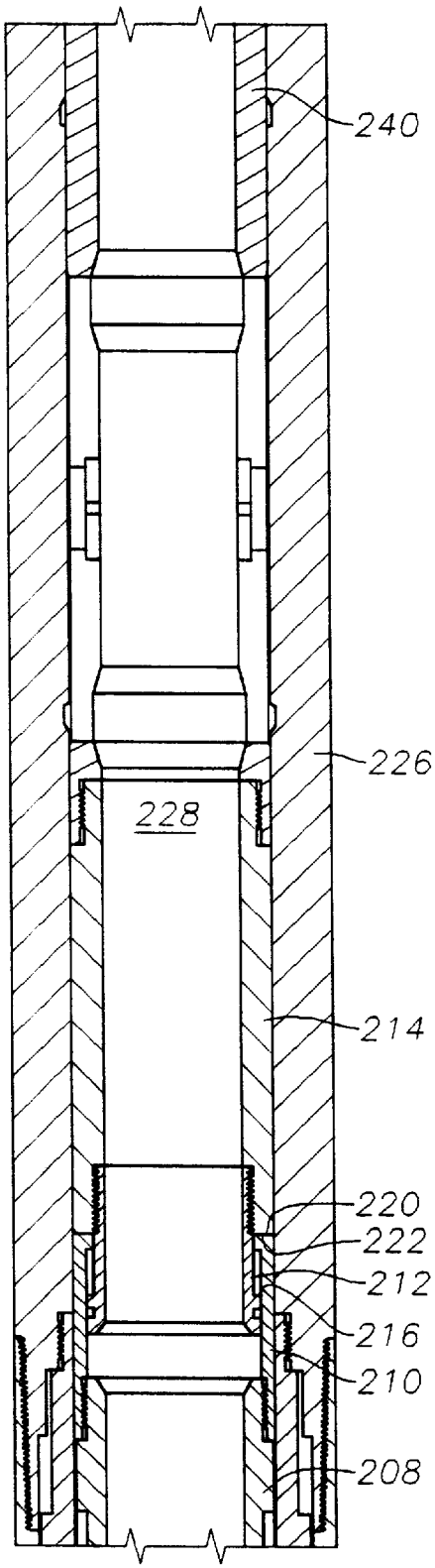

The actuating member 206 is threadably connected a connector member 208, which in turn is threadably connected to a sleeve 210. The sleeve 210 near its top end provides a shoulder 216 for mating with a corresponding shoulder of a "lost-motion" sleeve member 212 that is threadably connected to an operator mandrel 214 that further forms part of the ball valve operator. In the position shown, the operator mandrel 214 is in its up position so that the assembly including the actuating member 206, connector member 208 and sleeve 210 are held in the position shown by the lost-motion sleeve 212. A space 218 is formed so that a gap is provided between the top surface 220 of the sleeve 210 and the bottom surface 222 of the operator mandrel 214. The space 218 provides lost motion when the operator mandrel 214 is actuated to move down. The initial distance traversed by the operator mandrel 214 when it is initially activated is lost motion in that the assembly including members 206, 208 and 210 are not moved by the initial movement of the operator mandrel 214 until the operator mandrel bottom surface 222 contacts the sleeve top surface 220. FIG. 4D shows the ball valve operator mandrel 214 in its down position, with the gap 218 completely traversed by the operator mandrel 214. As explained below, this lost motion is used to allow for operation of the sleeve valve 114 before the ball valve 116 is actuated. This is done since travel of the sleeve valve during actuation is larger than travel of the ball valve during actuation.

The operator mandrel 214 runs for some distance along the length of the multiple valve isolation section 190 inside the housing section 226. In one embodiment, the length of the operator mandrel 214 can be made long enough such that debris generated during wellbore operations can fit in the inner bore 228 of the multiple valve isolation section 190 without plugging the entire assembly and blocking fluid flow. The top portion of the operator mandrel 214 is threadably connected to a latch assembly 224 that is longitudinally moveable by a shifting tool (not shown) passed through the inner bore 228 of the multiple isolation assembly 190. The latch assembly 224 includes a pair of collet fingers 228A and 228B, with the first collet finger 228A having a first end 232A and a second collet finger having a second end 232B. The second end 232B is disposed in a detent 230. The isolation latch assembly 224 will move longitudinally when a shifting tool is run through the center of the multiple valve isolation assembly 190 and catches one of the first or second end members 232A or 232B of the collet fingers 228A, B. Movement of the latch assembly 224 opens or shuts the ball valve 116 and sleeve valve 114.

Coupled above the latch assembly 224 is a latch mandrel 240. The latch mandrel 240 is in turn coupled to a connector section 242 that mechanically couples the ball valve assembly and the sleeve valve assembly, as further described below. According to one embodiment, the ball valve and the sleeve valve are mechanically coupled so that they can be actuated together.

Alternatively, the mechanical coupling of the ball valve and the sleeve valve may be removed so that the ball valve and sleeve valve may be independently actuated by separate mechanisms.

The latch mandrel 240 has flange portions 244 that are bolted to corresponding connector rods 248. As further illustrated in FIG. 6, multiple (e.g., four) connector rods connected to the latch mandrel 240 are placed in longitudinal bores 249 in the housing section 252. Each rod 248 is held laterally by a corresponding nut 254 that is threadably connected to the housing section 252. A seal 256 is provided around a portion of each rod 248. The connector rods 248 form part of the connector section 242 between the sleeve valve assembly and the ball valve assembly such that one mechanism (e.g., shifting tool or tripsaver section) may be used to actuate both the sleeve valve and the ball valve in the multivalve isolation assembly 190.

Figure 7:
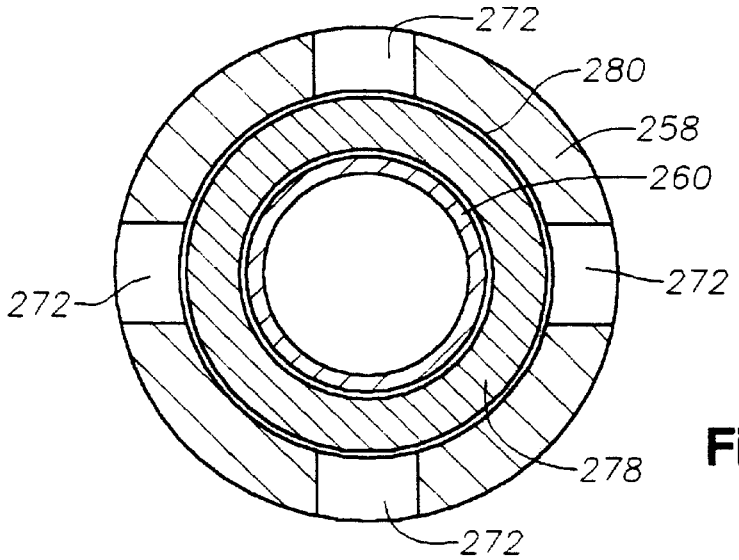

Proceeding further up the multivalve isolation assembly 190, the sleeve valve assembly 114 includes a slot 272 having an angled section 274 to direct fluid flow into the slot 272. In the sleeve valve assembly 114, the connecting rods 248 are screwed into a member 276 that is threadably coupled to a sleeve member 278 that includes a seal 280 to block fluid from flowing when the sleeve valve assembly is in its closed position as illustrated. Packing seals 262 and 264 are inserted between the housing section 258 and the sleeve member 278. Referring further to FIG. 7, which shows a cross-section of the sleeve valve assembly 114, multiple slots 272 are provided.

A flow tube section 260 (also referred to as a "stinger") is threadably coupled to the housing section 252 to provide a fluid seal between the inner bore 228 and the sleeve valve assembly 114. The flow tube section 260 extends a relatively long distance up the multivalve isolation assembly 190 and forms part of the flow tube illustrated in FIG. 1.

Figure 8:
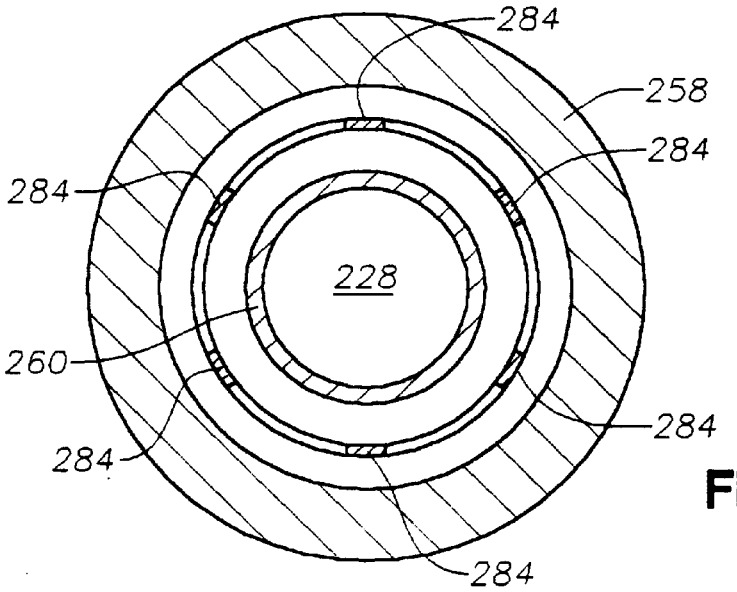

To actuate the sleeve valve assembly 1-14, an assembly of segmented fingers 284 are aligned with respect to the top surface 286 of a sleeve valve operator 287 in the sleeve valve assembly 114 such that when the segmented fingers 284 (cross-section shown in FIG. 8) are pushed downward, the sleeve valve operator 287 is actuated to push the sleeve member 278 downward. As illustrated in FIG. 8, six segmented fingers are connected. The downward actuation in turn moves the connecting rods 248 downward along with the latch mandrel 240, the latch assembly 224, and the operator mandrel 214 to thereby actuate the ball valve 116 after the ball valve operator mandrel 214 has traversed the gap 218 (FIGS. 2F, 4D).

The segmented fingers 284 are connected to the bottom of a tubular member 288 that forms part of a tripsaver section 301 that uses applied fluid pressure to actuate the valves 114 and 116. The tubular member 288 is fixed in position by an alignment pin 292 that aligns the segmented fingers 284 with respect to the slots 272 when the fingers 284 are moved downward adjacent the slots 272. The alignment pin 292 ensures that the fingers 284 do not block flow of fluid into the slots 272 once the sleeve valve assembly 114 is moved downward to its open position, as shown in FIG. 4C.

Formed in the outer wall of the tubular member 288 are J-slots (explained further below) that work in conjunction with a J-slot pin 328 to form parts of a counter section 300 that counts the number of cycles of applied fluid pressure.

The tubular member 288 is connected to a power mandrel 294 that is actuable by fluid pressure once the counter section 300 has counted a predetermined number of cycles. The power mandrel 294 is also part of the tripsaver section 301. After a predetermined number of cycles of fluid pressure, the counter section 300 is actuated to allow fluid pressure to move the power mandrel 294 downward to operate the sleeve valve 114 and the ball valve 116. Application and removal of fluid pressure causes the power mandrel 294 and tubular member 288 to move up and down, with each up and down movement of the power mandrel 294 making a cycle. In FIGS. 2C and 2D, the power mandrel 294 and tubular member 288 are shown in their down position when no applied fluid pressure is present.

Figure 2A:
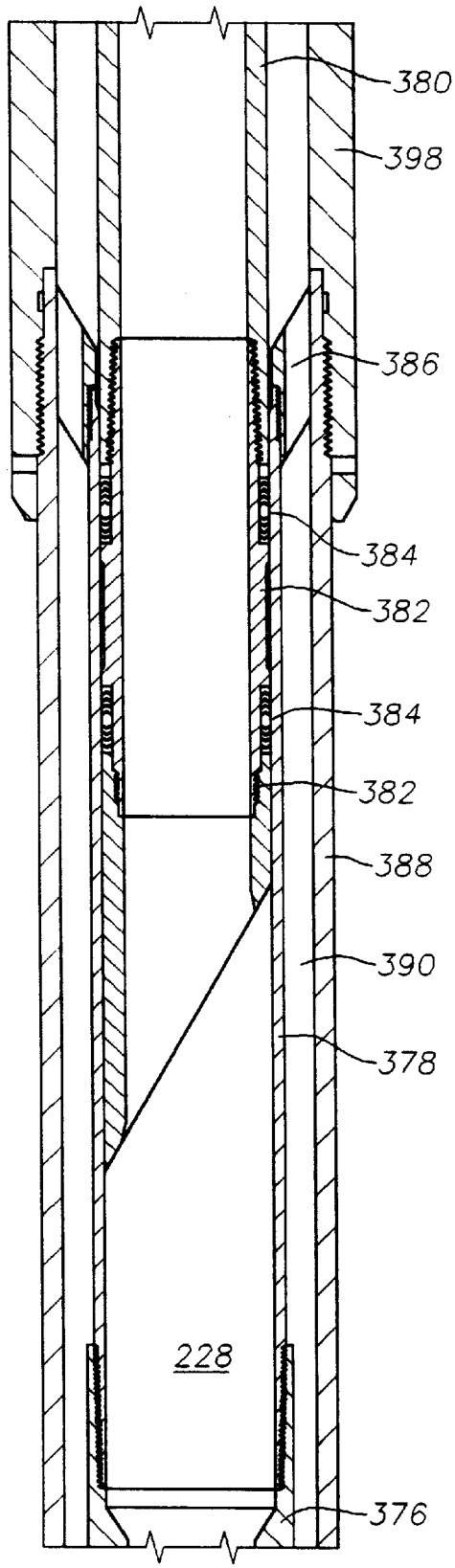
FIGS. 2A–2G are diagrams of a multivalve isolation assembly in a closed position in the formation isolation system of FIG. 1.
Figure 2B:
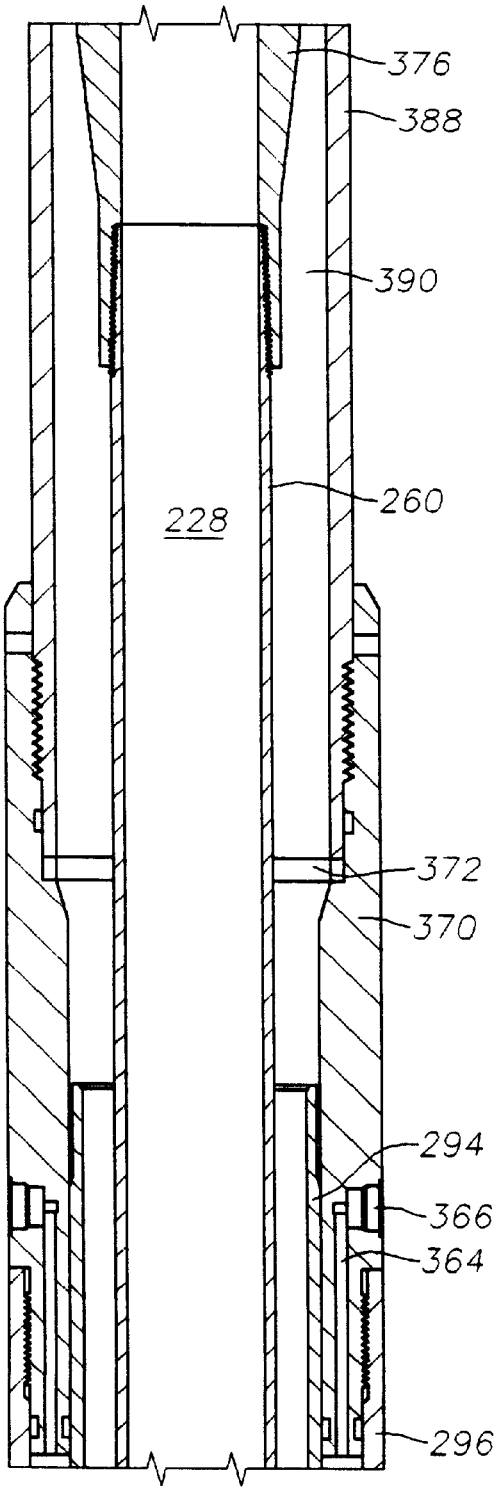
Figure 2C:
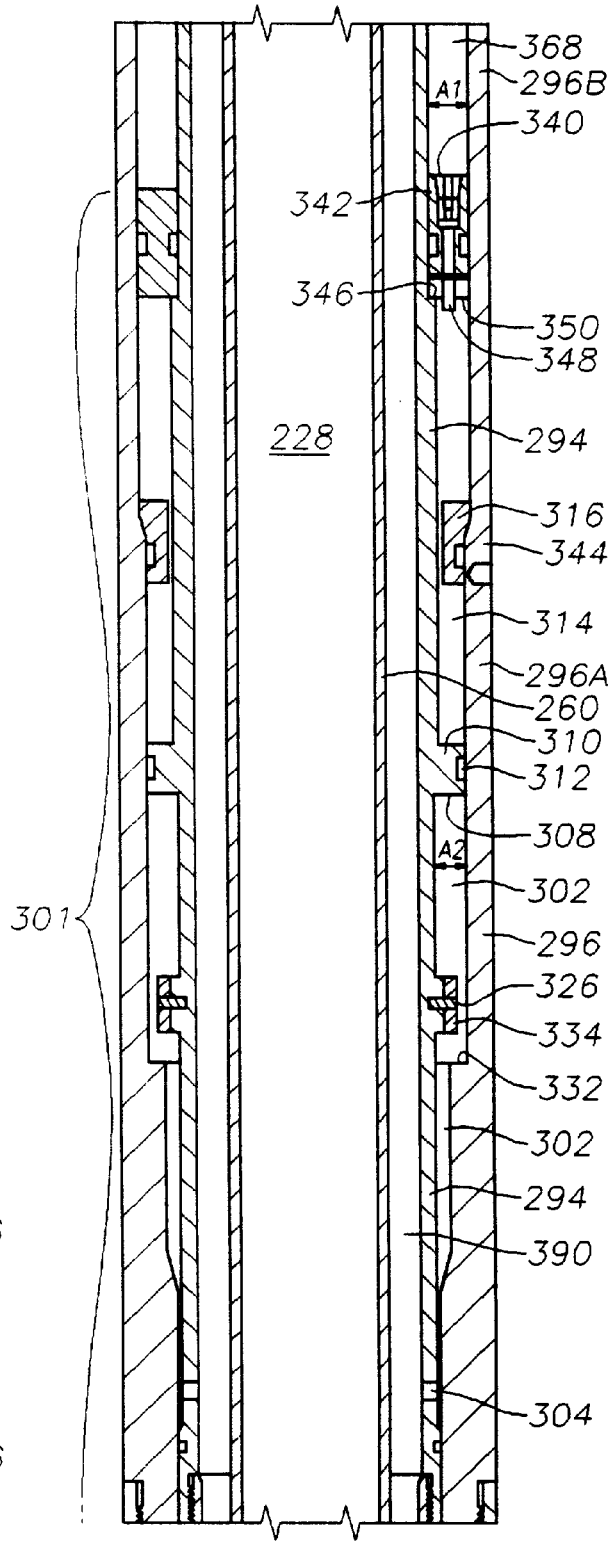
Figure 2D:
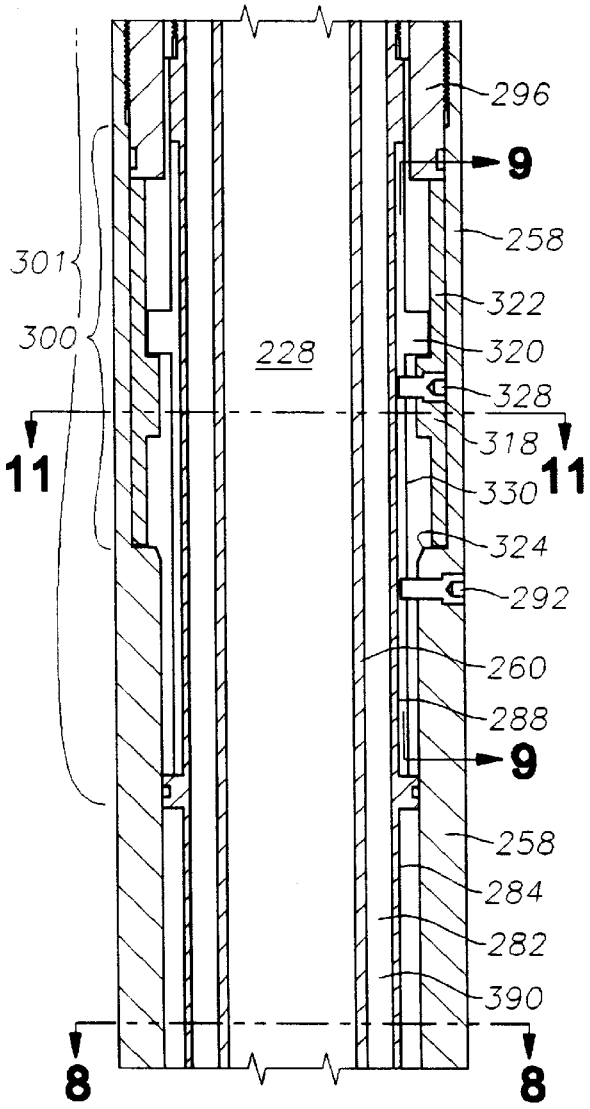
Figure 2E:
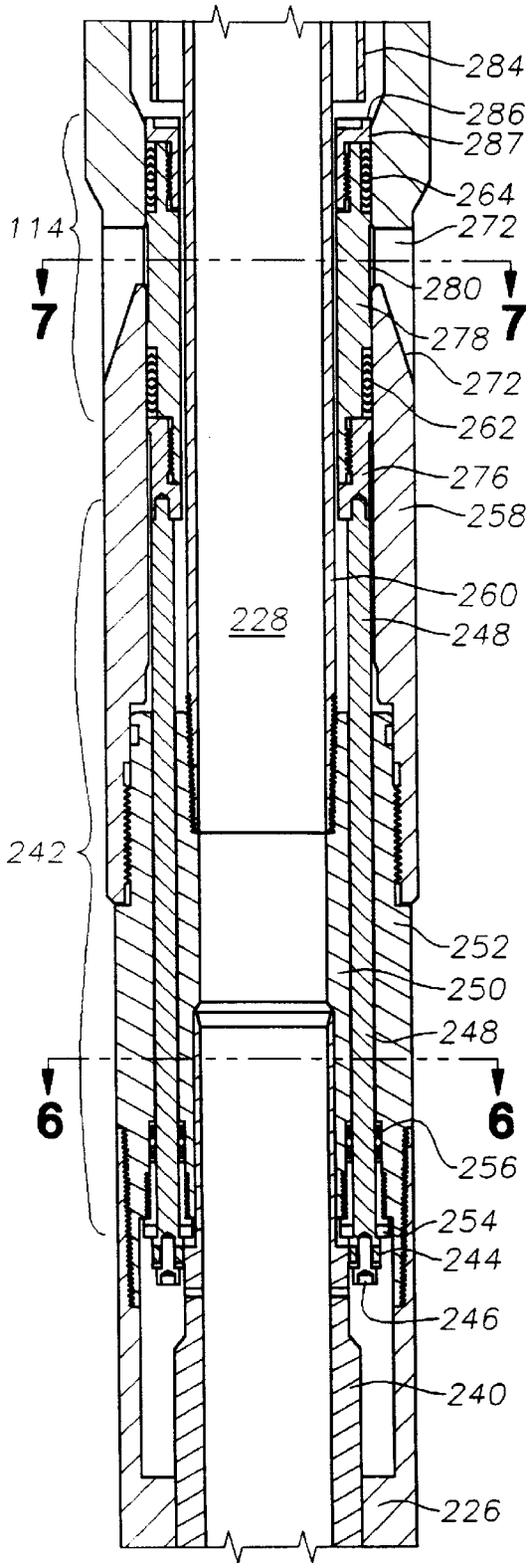
Figure 2F:
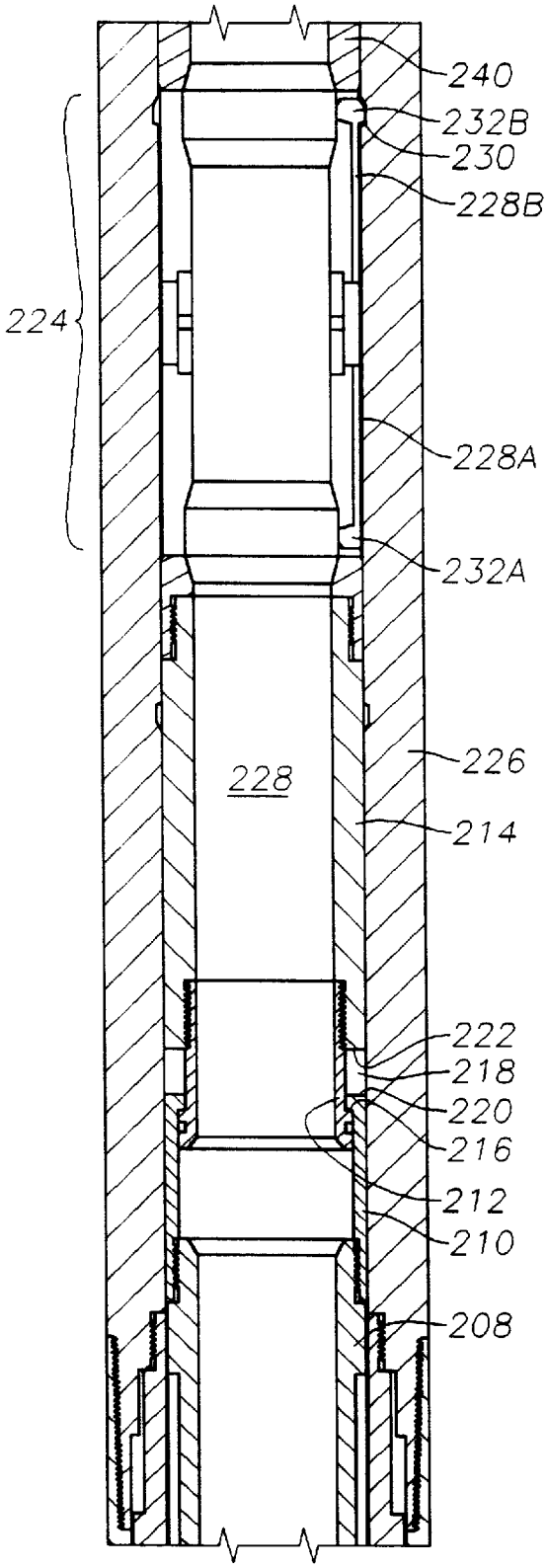
Figure 2G:
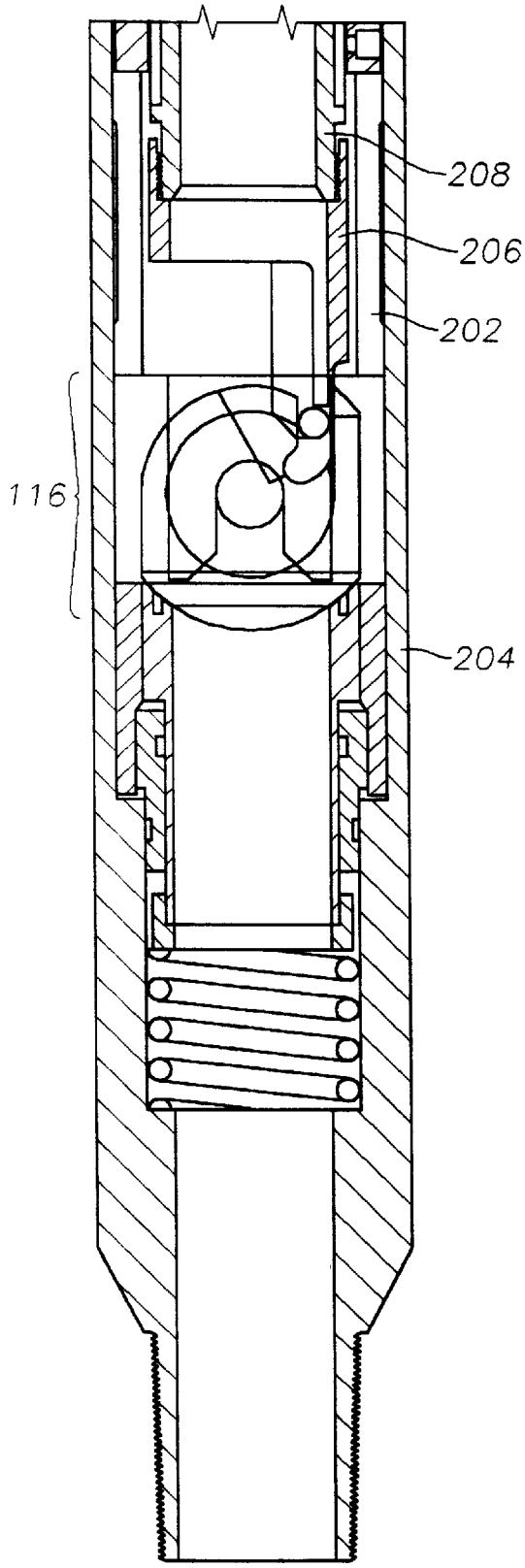
Figure 3A:
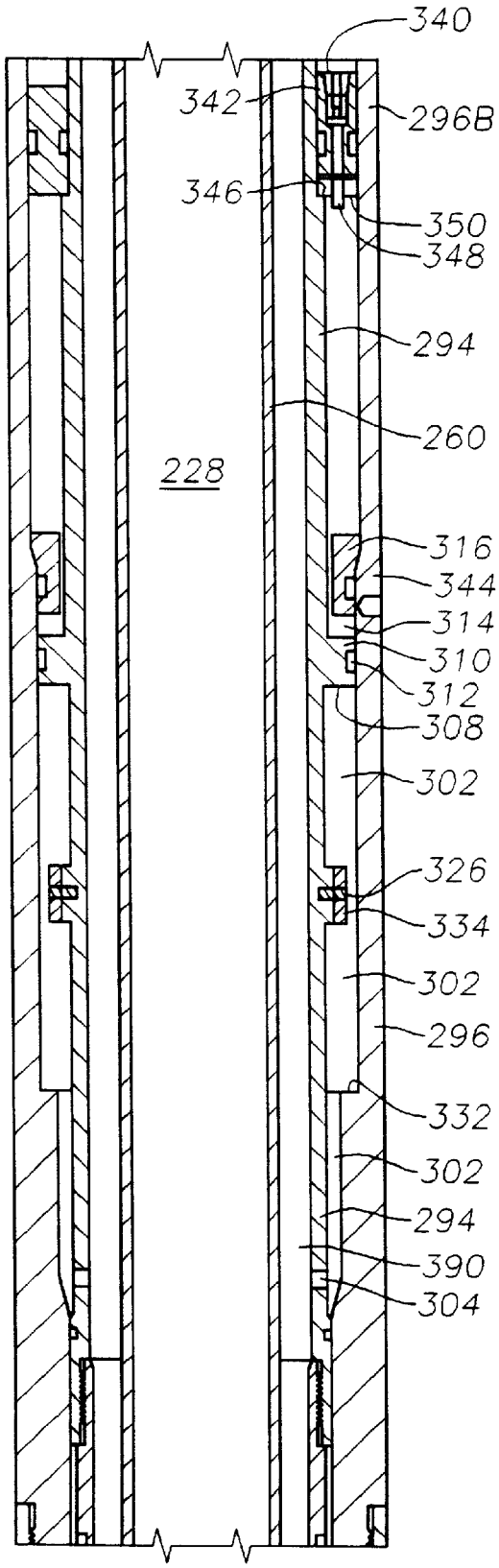
FIGS. 3A–3B are diagrams of the multivalve isolation assembly in a closed position with applied fluid pressure.
Figure 3B:
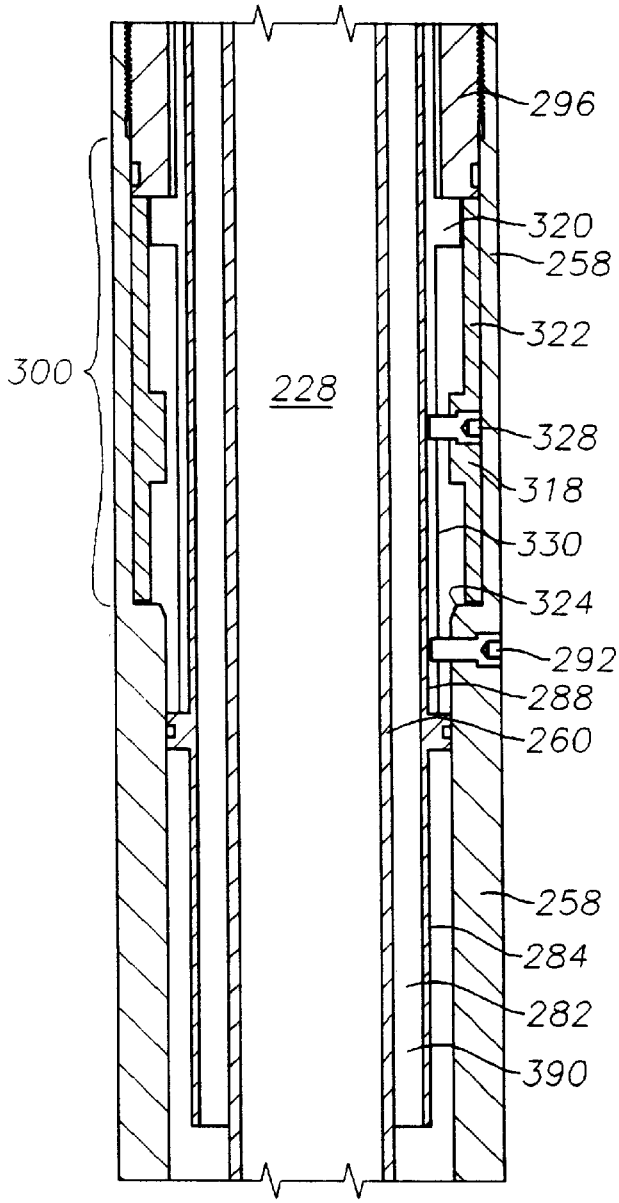

When fluid-pressure is applied, the power mandrel 294 and tubular member 288 move up, as illustrated in FIGS. 3A and 3B, which correspond exactly to FIGS. 2C and 2D except for movement of the power mandrel 294 and tubular member 288 and other connected components. After a predetermined number of cycles, as shown in FIGS. 4A–4E, the counter section 300 allows the power mandrel 294 to push the segmented fingers 284 down to contact the top surface 286 of the sleeve member 278 to actuate the sleeve valve 114 as well as move the connecting rods 248 which further move coupled components downstream to actuate the ball valve 116. FIGS. 4A–4E correspond exactly to FIGS. 2C–2G except for movement of the operator mechanisms of the ball valve 116 and the sleeve valve 114.

Referring again to FIG. 2C, the power mandrel 294 includes a slot 304 through which fluid can flow through an annular region 390 between the outer surface of the flow tube 260 and the inner surface of the power mandrel 294. Fluid flows through the port 304 of the power mandrel 294 up to another annular region 302 to the bottom surface 308 of a flange portion 310 on the power mandrel 294 that is sealed by an O-ring seal 312. Above the flange portion 310 is another chamber 314 that is an air or other gas chamber that is at approximately atmospheric pressure. Thus, if a first force resulting from tubing fluid pressure applied through the annular space 390 on the bottom surface 308 of the flange portion 310 exceeds a second force resulting from formation fluid pressure applied on a top surface 340 of a member 342, the power mandrel 294 is pushed up, as illustrated in FIGS. 3A–3B. In the illustrated embodiment, the flange portion 310 stops short of a stop member 316 bolted to the housing section 296 when the power mandrel 294 is moved up by the applied pressure (FIG. 3A). When tubing pressure is subsequently removed, the force applied by the formation fluid pressure on surface 340 pushes the power mandrel 294 back down to the position illustrated in FIG. 2C.

The up and down movement as illustrated of the power mandrel 294 and the tubular member 288 causes the counter section 300 to count one cycle. The tubular member 288 includes flange portions 320 that protrude outwardly. In the position shown in FIG. 2D, the flange portions 320 sit on corresponding shoulders of protruding sections 318 of a rotatable spline sleeve 322 that is also part of the counter section 300.

After a predetermined number of pressure cycles, the spline sleeve 322 is rotated to a position that allows the power mandrel 294 to move down past the protruding sections 318 of the spline sleeve 322. The spline sleeve 322 is rotateable with respect to the power mandrel 294. Each up and down cycle of the power mandrel 294 causes the spline sleeve 322 to rotate a certain distance. In one embodiment, as shown in the cross-section of FIGS. 9 and 10, the power mandrel 294 includes three flange portions 320A–C. As further shown in FIG. 11, the spline sleeve 322 includes three protruding sections 318A–C. After a predetermined number of cycles, gaps 458A–C between the protruding sections 318A–C line up with the flange sections 320A–C of the power mandrel 294, allowing the power mandrel 294 to move down past the protruding sections 318 toward a shoulder 324 of the housing section 258 (after shear pins 326 are sheared as discussed further below).

The J-slot pin 328 is inserted through the spline sleeve 322 to move in a step-wise fashion along J-slots defined in the outer wall 330 of the tubular member 288 as the spline sleeve 322 is rotated. As the spline sleeve 322 is rotated, the J-slot pin 328 travels along a path defined by the J-slots generally along the circumference of the tubular member 288 outer wall 330, as shown in FIG. 9.

Figure 9:
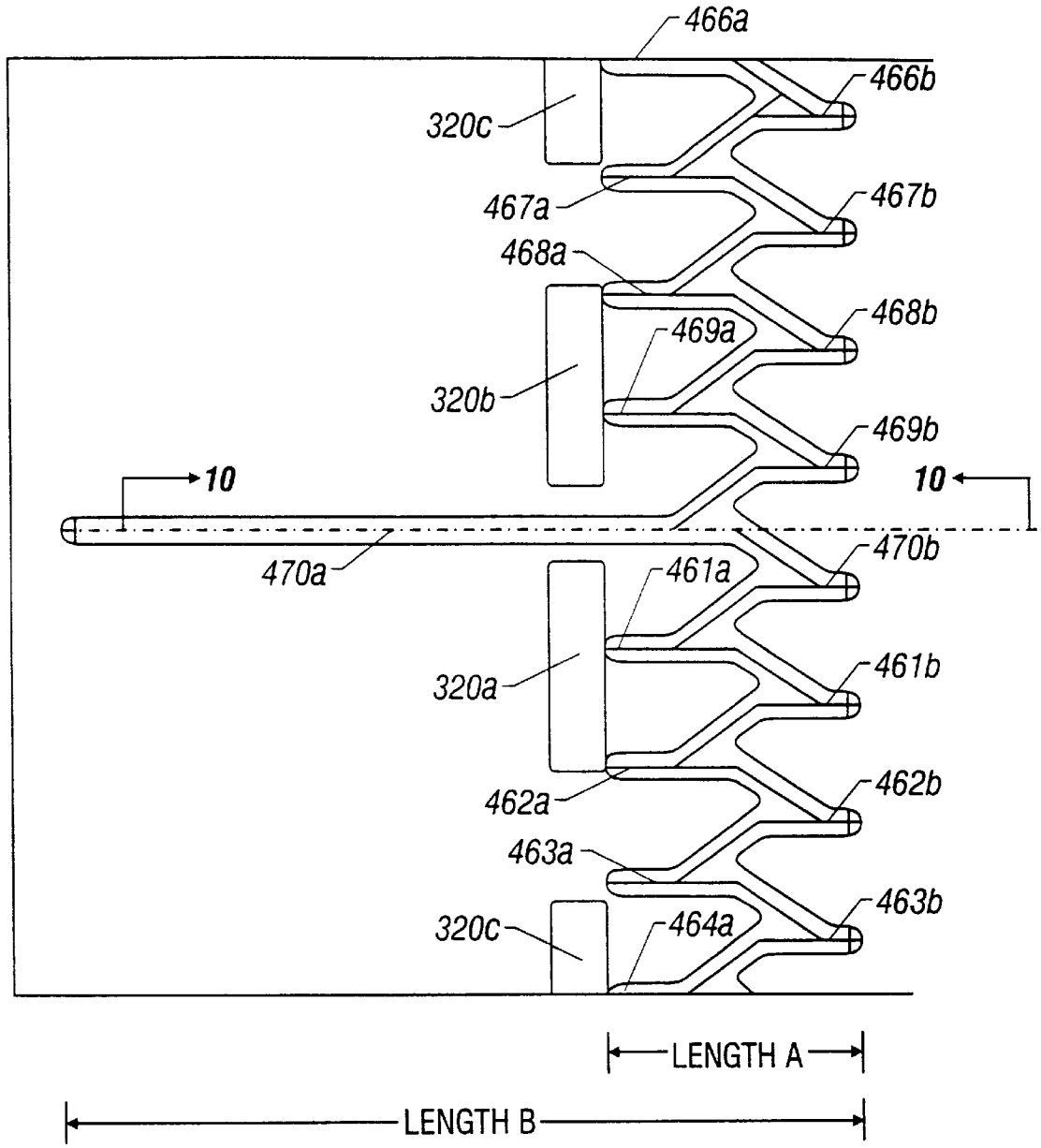
FIGS. 9–11 are different views of a counter section in the multivalve isolation assembly.
Figure 10:
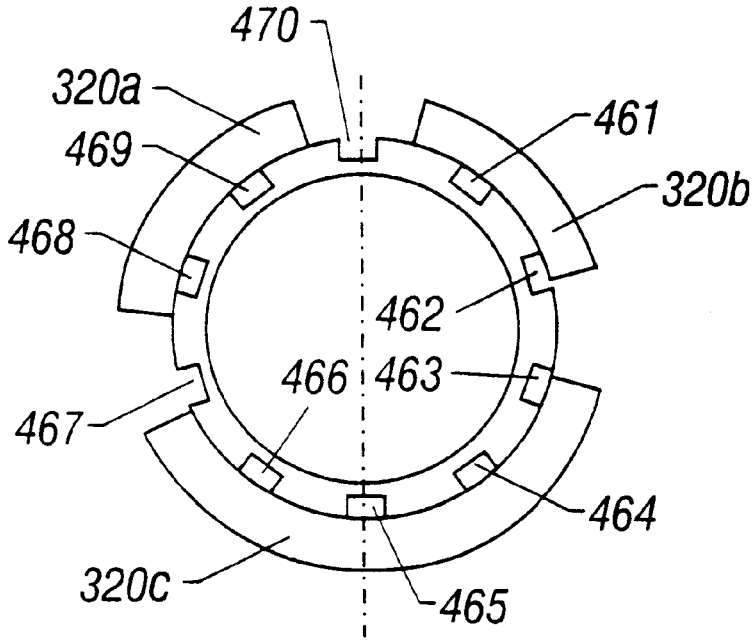
Figure 11:
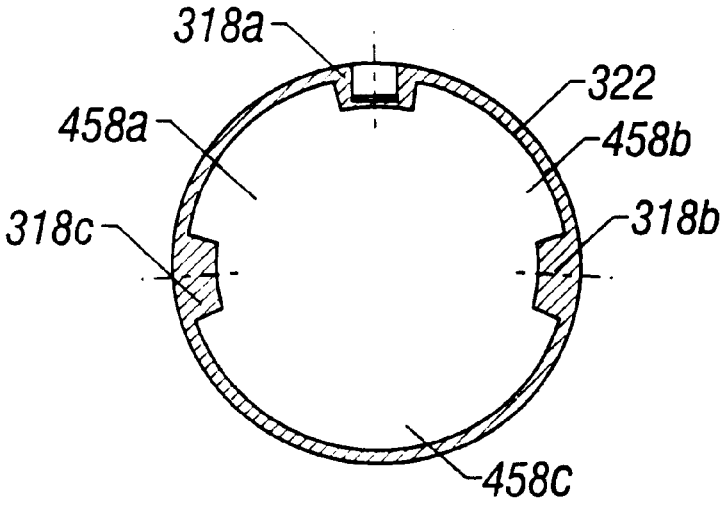

As illustrated in the different views of FIGS. 9 and 10, according to one embodiment, there are ten J-slots 461, 462, 463, 464, 465, 466, 467, 468, 469, and 470 in the tubular member 288. J-slots 461–469 are of the same length (length A), while J-slot 470 is of a longer length (length B). The shorter length J-slots 461-469 allow movement of the tubular member 288 and power mandrel in an up and down fashion along length A, but such movement does not allow the power mandrel to engage the sleeve valve operator 287. The J-slot pin 328 of the rotating spline sleeve 322 is rotatably urged along adjacent J-slots with each cycle of the power mandrel 294 and tubular member 288. The single long length counter track engagement J-slot 470 is designed to allow sufficient movement along length B of the tubular member 288 to allow the segmented fingers 284 to engage the sleeve valve operator 287.

Figure 4E:
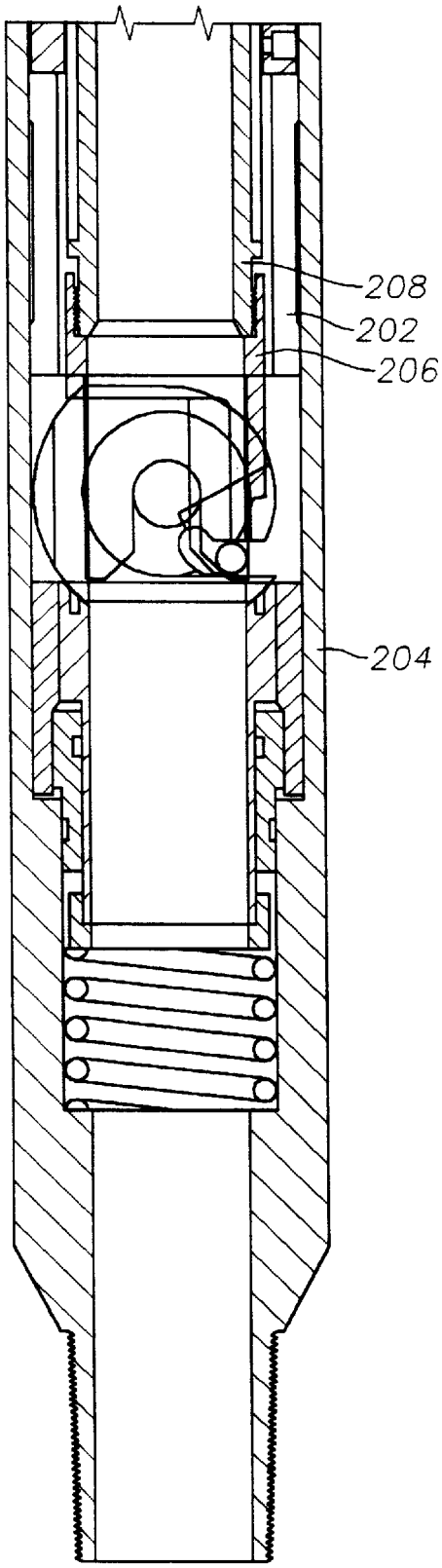
Figure 6:
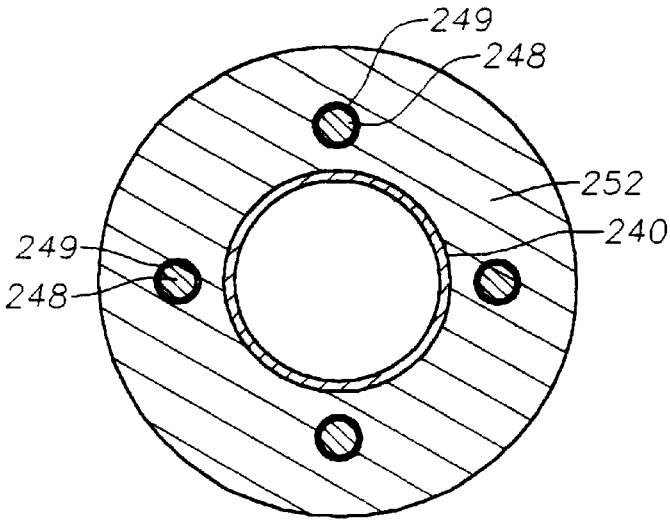
FIGS. 6, 7, and 8 are cross-sectional diagrams of portions of the multivalve isolation assembly.

In operation, the J-slot pin 328 can initially be located in slot 461A. When the tubular member 288 is pushed up by fluid pressure (acting on the power mandrel 294) the J-slot pin 328 travels along the path from the slot 461A to 461B. When the power mandrel 294 and the tubular member 288 moves back down again after fluid pressure is bleed off, the j-slot pin 328 travels along the path to find from slot 461B to slot 462A. This is repeated until the J-slot pin 328 reaches slot 469B. On the next down cycle of the power mandrel 294 and tubular member 288, the flange portions 320A–C line up with the gaps 458A–C, which then allows the J-slot pin 328 to travel along the extended slot 470A as the tubular member 288 moves down toward the shoulder 324 of the housing section 258. As a result, the segmented fingers 284 are pushed down to engage the sleeve valve operator 287 to open the sleeve valve 114 (as shown in FIGS. 4B and 4C). Subsequently, the ball valve operator mandrel 214 is actuated to open the ball valve 116 (as shown in FIGS. 4D and 4E).

As noted above, the shear pin 326 is sheared (shown in FIG. 4A) when the power mandrel 294 and tubular member 288 move in a downward direction by sufficient distance such that a sleeve 334 held against the outer wall of the power mandrel 294 by the shear pin 326 hits a shoulder 332 of the housing section 296 to prevent further movement of the power mandrel 294. This provides some time to bleed away the tubing string bore pressure (and thus the pressure in the bore 228 of the multivalve isolation assembly 190). This is done until a sufficiently large force differential is created to shear the shearing pins 326. Once the shearing pins 326 are sheared, the power mandrel 294 is allowed to drop down. By ensuring a pressure in the bore 228 of the multivalve isolation assembly 190 that is less than the formation pressure below the valve, damage can be avoided to the formation below the valve when the ball valve 116 or sleeve valve 114 is actually reopened.

If desired, the tubing bore fluid pressure can also be maintained at a high enough level that the shearing pins 326 are not sheared. As a result, down movement of the power mandrel 294 is prevented. If the tubing bore fluid pressure is not dropped low enough, then the sleeve valve 114 and ball valve 116 are not opened. This effectively resets the counter mechanism 300 on the next pressure up cycle. To activate the power mandrel again, the predetermined number of cycles must then be reapplied to the counter mechanism 300.

Figure 5:
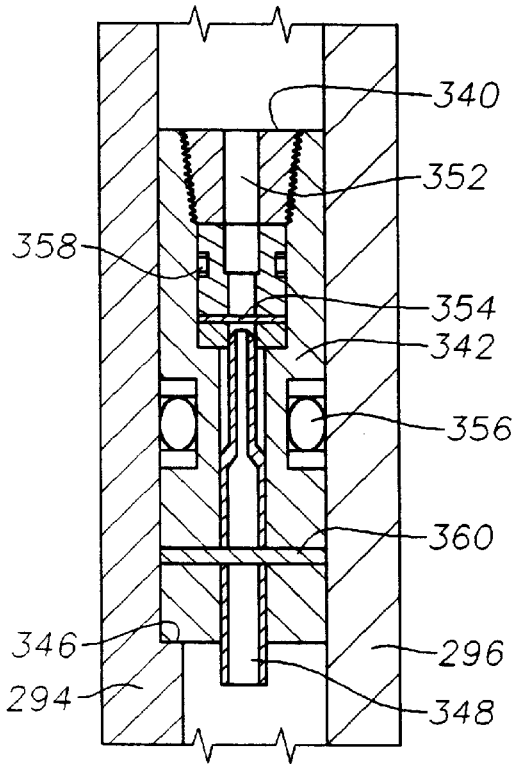
FIG. 5 is a blown up diagram of a fluid release member in the multivalve isolation assembly.

After the valves 114 and 116 are opened after tripsaver activation, formation fluid pressure is applied to a top surface 340 of a fluid release member 342 that sits partially on a shoulder 346 of the power mandrel 294. The formation fluid pressure tends to push the power mandrel 294 in a downward direction. Thus, if it is desired to use a shifting tool to later reclose the valves 114 and 116, this applied formation fluid pressure on surface 340 of the member prevents or makes difficult operation of the latch assembly 224 to close the valves 114 and 116. To remove this applied pressure and equalize pressure the atmospheric chamber 314 is filled with formation fluid and constant communication is established with formation fluid. To do so, and as illustrated in FIGS. 4A and 5 the member 342 includes a puncture rod 348 that has a portion protruding from the bottom surface 350 of the member 342. The member 342 includes a hole 352 through which fluid can flow, except that it is sealed by a rupture disk 354. O-ring seals 356 and 358 provide further seals to prevent fluid from flowing into the chamber 314. The puncture rod 348 is held in place by a shear pin 360, until the bottom surface of the puncture rod 348 impacts the stop member 316 when the power mandrel 294 is moved down to actuate the sleeve valve 114 and ball valve 116. When that occurs by application of sufficient pressure of the top surface 340 of the fluid release member 342, the puncture rod 348 impacts the stop member 316 with sufficient force to shear the shear pin 360 and to puncture a hole through the rupture disk 354, as illustrated in FIG. 4A. When the rupture disk 354 is punctured, well fluid is allowed to flow from a chamber 368 through the opening 352 into the chamber 314 to fill the atmospheric chamber 314 with fluid. Well fluid is allowed to flow into the chamber 368 through an opening 364 and a port 366 in the housing section 370. Effectively, the member 342 provides a mechanism to establish through fluid communication between chambers to equalize pressure.

As illustrated in FIG. 2C the housing section 296 has a first portion 296A and a second portion 296B, with the portion 296B being thinner than the portion 296A by a predetermined amount. The housing section 296 thins down near around a location generally indicated as 344. Because the housing section 296B is thinner, a cross-sectional area A1 of the chamber 368 defined between the outer wall of the power mandrel 294 and the inner wall of the housing section 296B is greater than an area A2 of the chamber 302 defined between the outer wall of the power mandrel 294 and the inner wall of the housing section 296A. Formation fluid pressure in the chamber 368 is applied on the top surface 340 of the fluid release member 342 having area A1, and tubing fluid pressure in the chamber 302 is applied on the bottom surface 308 of the flange portion 310. Because force is pressure multiplied by area, even though the same amount of fluid pressure is applied in the chamber 368 as in the chamber 302, the force applied on the top surface 340 of the fluid release member 342 is greater than the force applied on the bottom surface 308 of the flange portion 310 of the power mandrel 294. This facilitates movement of the power mandrel 294 in the down direction. The assembly including the elements defining the fluid chambers 368 and 302 and the atmospheric chamber 314 provide an atmospheric biasing assembly according to one embodiment to allow power to be applied to elements (including the power mandrel 294) downhole.

Proceeding further up the tool, as shown in FIG. 2B, a centralizer 372 is inserted between the outer wall of the flow tube 260 and the inner wall of the housing section 370 to maintain the flow tube 260 in an approximately central position. Further up, the flow tube 260 is threadably connected to a member 376, which in turn is threadably connected to a receptacle 378 (which may be a polished bore receptacle) that is used to receive the bottom portion 382 of another flow tube section 380. The flow tube section 380 and its bottom portion 382 are sealed using packing seals 384. A centralizer 386 is used to maintain the central position of the flow tube section 380. The flow tube section 380 is in turn connected further up to the flow control device 100. The flow tube section 380 and packing seals 384 are part of a floating seal assembly that is received by the receptacle 378, which may be a relatively long length. To provide reliable engagement of the floating seal assembly and receptacle 378, the floating seal assembly is movable longitudinally in the receptacle 378 to allow a reliable sealed coupling to isolate the separate fluid paths through 228 and 390. When the sleeve valve is opened as illustrated in FIG. 4C, fluid from the second zone 22 flows through the port 272 into the passage way 390 that extends upwards to the flow control device 100 (see FIGS. 4A–4C). The angled portion 274 of the port 272 directs fluid flow upwards to reduce erosion of the port.

Other embodiments as also within the scope of the following claims. For example, although in the illustrated embodiments of FIGS. 2–4, the sleeve valve 114 and the ball valve 116 are shown to be mechanically coupled such that one mechanism may be used to actuate both valves 114 and 116, an alternative embodiment contemplates separate mechanisms to actuate the sleeve valve 114 and the ball valve 116. For example, the ball valve 116 may be actuatable with its own latch assembly and tripsaver section while the sleeve valve 114 is actuatable by use of a separate latch assembly and tripsave section. The separate latch assemblies may have different profiles so that a shifting tool may be used to actuate one or the other of the ball and sleeve valves, or alternatively, they may have similar profiles such that a shifting tool may actuate both valves in one run.

In addition, although the formation isolation system in the illustrated embodiment is used with a multi-zone well, the formation isolation system may also be used with a single-zone well.

While the invention has been disclosed with respect to a limited number of embodiments, those skilled in the art will appreciate numerous modifications and variations therefrom. For example, the particular embodiment chosen to manufacture a particular shaped charge depends upon manufacturing techniques available at any given time. It is intended that the appended claims cover all such modifications and variations as fall within the spirit and scope of the invention.

What is claimed is:

1. A valve assembly for use in a well comprising:

first and second fluid paths, the first fluid path extending to a first zone at a first location in the well and the second fluid path extending to a second, different location, at least a portion of the second fluid path being an annular path around a portion of the first fluid path;

a first valve for controlling fluid flow in the first fluid path;

a second valve for controlling fluid flow in the second fluid path;

a first operator to actuate the first valve;

a second operator to actuate the second valve, wherein the first and second operators are operably coupled; and a lost motion mechanism between the first and second operators.

2. The valve assembly of claim 1, wherein the first operator moves a predetermined distance before the second operator moves during actuation of the first and second valves.

3. A valve assembly for use in a well comprising:

first and second fluid paths, the first fluid path extending to a first zone at a first location in the well and the second fluid path extending to a second zone at a second, different location, at least a portion of the second fluid path being an annular path around a portion of the first fluid path;

a first valve for controlling fluid flow in the first fluid path;

a second valve for controlling fluid flow in the second fluid path;

a housing defining a first chamber and a second chamber capable of receiving fluid and having different cross-sectional areas;

an operator coupled to at least one of the first and second valves, the operator comprising a mandrel having an upper surface on which force from fluid pressure in the first chamber is applied and a lower surface on which force from fluid pressure in the second chamber is applied; and an atmospheric chamber defined by the housing between the first and second chambers.

4. The valve assembly of claim 3, wherein the operator is actuated by a pressure differential between the first chamber and the atmospheric chamber.

5. The valve assembly of claim 4, further comprising a pressure equalization mechanism to equalize pressure in the first chamber and the atmospheric chamber upon occurrence of a predetermined event.

6. A valve assembly for use in a well comprising:

first and second fluid paths, the first fluid path extending to a first zone at a first location in the well and the second fluid path extending to a second zone at a second, different location, at least a portion of the second fluid path being an annular path around a portion of the first fluid path;

a first valve for controlling fluid flow in the first fluid path;

a second valve for controlling fluid flow in the second fluid path; and an operator coupled to at least one of the first and second valves, the operator having a member between first and second chambers in a tool, the member comprising a bore in communication with the first and second chambers, a seal being in the bore to prevent fluid communication through the bore, and a puncture rod positioned in the bore and capable of longitudinal movement in the bore to puncture the seal to allow fluid communication through the bore for equalizing pressure in the first and second chambers.

* * * * *